US011957279B2

(12) United States Patent
Larsson

(10) Patent No.: US 11,957,279 B2
(45) **Date of Patent: *Apr. 16, 2024**

(54) SEPARATION UNIT AND A DISPENSER COMPRISING A SEPARATION UNIT

(71) Applicant: Essity Hygiene and Health Aktiebolag, Gothenburg (SE)

(72) Inventor: Bjorn Larsson, Billdal (SE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

This patent is subject to a terminal disclaimer.

(21) Appl. No.: 17/954,046

(22) Filed: Sep. 27, 2022

(65) Prior Publication Data

US 2023/0019551 A1 Jan. 19, 2023

Related U.S. Application Data

(63) Continuation of application No. 16/642,162, filed as application No. PCT/SE2017/050872 on Sep. 1, 2017, now Pat. No. 11,484,162.

(51) Int. Cl.

| | |
|---|---|
| ***A47K 10/36*** | (2006.01) |
| ***B26F 3/00*** | (2006.01) |
| ***B65H 20/02*** | (2006.01) |

(52) U.S. Cl.

CPC ..... *A47K 10/3643* (2013.01); *B65H 20/02* (2013.01); *B65H 2301/5152* (2013.01); *B65H 2301/5155* (2013.01); *B65H 2404/144* (2013.01)

(58) Field of Classification Search

CPC . Y10T 225/35; Y10T 225/30; Y10T 225/329; Y10T 225/371; Y10T 225/379;

(Continued)

(56) References Cited

U.S. PATENT DOCUMENTS 5,265,864 A 11/1993 Roux et al.
5,653,439 A 8/1997 Rider et al.

(Continued)

FOREIGN PATENT DOCUMENTS

CN 104736029 A 6/2015
WO 2011149392 A1 12/2011

(Continued)

OTHER PUBLICATIONS

International Searching Authority, Preliminary Report on Patentability issued in International Application No. PCT/SE2017050872 dated Aug. 23, 2019 (8 pages).

(Continued)

*Primary Examiner* — Phong H Nguyen
(74) *Attorney, Agent, or Firm* — CANTOR COLBURN LLP

(57) ABSTRACT

A separating unit for separating a web material includes a first shaft extending along a first longitudinal axis in the width direction and a second shaft extending along a second longitudinal axis, parallel to the first shaft. The second longitudinal axis is separated from the first longitudinal axis in a direction perpendicular to the width direction. A first protrusion element extends perpendicularly from the first shaft and is rotatable about the first longitudinal axis and a second protrusion element extends perpendicularly from the second shaft and is rotatable about the second longitudinal axis. In a use position, the first protrusion element partially overlaps the second protrusion element with a radial overlap oriented perpendicular to the first and second shafts. A contact element is biased against at least one of the first and second protrusion elements in a direction perpendicular to the first or second longitudinal axis.

22 Claims, 7 Drawing Sheets

(58) Field of Classification Search
CPC .... A47K 10/36; A47K 10/3643; A47K 10/44; A47K 10/16; A47K 10/3612; A47K 10/426; A47K 10/24; A47K 10/32; A47K 10/34; A47K 10/3618; A47K 2010/3881; A47K 2010/3675; B26F 3/00; B26F 3/002; B65H 20/02; B65H 2404/1311; B65H 2404/143; B65H 2701/12112; B65H 75/28; B65H 75/285
USPC ..... 242/521, 564, 564.3, 564.4, 580, 580.1
See application file for complete search history.

(56) References Cited

U.S. PATENT DOCUMENTS

| | | | |
|---|---|---|---|
| 9,999,325 | B2 | 6/2018 | Larsson et al. |
| 10,058,221 | B2 | 8/2018 | Larsson et al. |
| 10,390,664 | B2 | 8/2019 | Larsson et al. |
| 10,568,471 | B2 | 2/2020 | Larsson et al. |
| 10,842,329 | B2 | 11/2020 | Larsson et al. |
| 11,166,604 | B2 | 11/2021 | Larsson et al. |
| 11,206,956 | B2 | 12/2021 | Larsson et al. |
| 2006/0214360 | A1 | 9/2006 | Neuber et al. |
| 2013/0105614 | A1 | 5/2013 | Hjort et al. |
| 2015/0150423 | A1 | 6/2015 | Pommer et al. |
| 2015/0297042 | A1 | 10/2015 | Larsson et al. |
| 2017/0042392 | A1 | 2/2017 | Larsson et al. |
| 2020/0383530 | A1 | 12/2020 | Larsson et al. |
| 2021/0068595 | A1 | 3/2021 | Arsson |
| 2021/0085133 | A1 | 3/2021 | Larsson et al. |
| 2021/0321832 | A1 | 10/2021 | Larsson et al. |

FOREIGN PATENT DOCUMENTS

| | | | |
|---|---|---|---|
| WO | 2013007302 | A2 | 1/2013 |
| WO | 2014065730 | A1 | 5/2014 |
| WO | 2014065731 | A1 | 5/2014 |
| WO | 2014065732 | A1 | 5/2014 |
| WO | 2014065738 | A1 | 5/2014 |
| WO | 2014098669 | A1 | 6/2014 |
| WO | 2015167371 | A1 | 11/2015 |

OTHER PUBLICATIONS

International Searching Authority, Search Report issued in International Application No. PCT/SE2017050872 dated Apr. 25, 2018 (4 pages).
International Searching Authority, Writen Opinion issued in International Application No. PCT/SE2017050872 dated Apr. 25, 2018 (5 pages).
National Intellectual Property Administration (CNIPA) of the People's Republic of China, First Office Action and Search Report in related application No. CN 201780094251.2, dated Sep. 27, 2020 (with English translation), 13 pages.
U.S. Non-Final Office Action; U.S. Appl. No. 16/642,162; dated Mar. 11, 2022; 24 pages.
Valea Technology & Law, Demand for Preliminary Examination and Response to Written Opinion filed in International Application No. PCT/SE2017/050872 dated Jun. 24, 2019 (4 pages).

SEPARATION UNIT AND A DISPENSER COMPRISING A SEPARATION UNIT

CROSS-REFERENCE TO RELATED APPLICATIONS

This application is a Continuation of U.S. Non-Provisional application Ser. No. 16/642,162, filed Feb. 26, 2020, which is a national phase entry of International Application No. PCT/SE2017/050872, filed Sep. 1, 2017, the disclosures of which are incorporated herein by reference in their entirety.

TECHNICAL FIELD

The present invention concerns a separation unit for separating a web material such as paper towels, tissue paper, or nonwoven material along preformed lines of weakness.

The present invention further relates to a dispenser for a web material, comprising a housing defining a web material reservoir, a dispensing opening, and a separation unit.

BACKGROUND

Many types of dispensers for web material provided with pre-formed weakening lines, such as perforation lines, dividing the web material into individual products for use e.g. as towels or wipes are available on the market today. The dispensers may be adapted for dispensing web material initially provided in the form of a roll or in the form of a folded stack.

Automatic dispensers may be electronically manoeuvred, and store and advance the paper towels with different kinds of control devices, sensors and power sources available. In particular, touch-free dispensers may be used to automatically feed a towel to a user. Manual dispensers may rely only on the force submitted by a user, e.g. pulling the outermost towel of the web material, in order to advance paper towels to the user.

A dispenser for web material with preformed lines of weakness may be provided with a separation unit for separating a sheet of web material along a line of weakness from the web material in the dispenser. The separation unit may comprise a nip through which the web material is arranged to pass. A line of weakness of the web material may break within the nip or outside the nip as a user pulls on the leading portion of the web material.

However, to realize the dispenser as described above a number of problems must be solved, including separating the webs correctly along the lines of weakness, feeding the next portion of the web to be separated to the separation unit, and presenting the leading end of the web to the next user. Furthermore, separation shall be possible for different types of web materials and web materials having different lengths between the lines of weakness.

WO2014/065738 concerns a separation unit for separating a perforated web material along preformed lines of weakness. The separation unit has a width direction and comprises at least a first shaft having a longitudinal axis extending in said width direction and a web width extending in said width direction, and at least a second shaft having a longitudinal axis extending parallel with said longitudinal axis of said first shaft and a web width extending in said width direction. The longitudinal axis of said second shaft is positioned at a distance from said longitudinal axis of said first shaft, said distance extending in a direction perpendicular to said width direction. Each of said first and said second rollers is provided with at least one protrusion element extending perpendicularly from said axes, wherein each of said protrusion elements has a maximum width in said width direction, a maximum radial extension from said rotational axes, an inner portion adjacent to said rotational axes, and an outer portion remote from said rotational axes, wherein said outer portions of said protrusion elements on said first shaft are arranged in a staggered relationship with said outer portions of said protrusion elements on said second shaft such that the outer portions of said protrusion elements on said first shaft are partially overlapping with said outer portions of said protrusion elements on said second shaft with a radial overlap length, thus forming an undulating passage for a web material between said rollers.

By the separation unit of WO2014/065738, the lines of weakness of a web material will be broken as a result of the web material passing through the undulating passage. This type of separation unit is particularly useful when it is desired to accomplish separation of a web material comprising lines of weakness, while treating the web material leniently. Hence, dispensing of relatively soft and/or weak web materials may be enabled without risk of the dispensing damaging the web material. For example, using a separation unit as in WO 2014/065738, dispensing of web material may be performed by a user pulling the tail of the web material with a pull-out force in the range about 4-7 N.

In particular, the separation unit of WO2014/065738 has shown to be useful when dispensing web material comprising at least two webs, each web being divided into individual sheets by lines of weakness, where the two webs are arranged in relation to one another such that the lines of weakness of the first web and the lines of weakness of the second web are offset with respect to one another along the webs. For separating such a web, it is of importance that while the separation along a line of weakness of one of the webs is performed, the separation unit should not damage the web material of the other web, which is located adjacent the line of weakness to be separated.

A web material as described in the above may be provided in the form of a roll or in the form of a folded stack. WO2014/098669 discloses an example of such a web material.

Although the separation unit of WO2014/065738 may provide highly reliable separation along the weakening lines of web material, it has been found that for some web materials, the reliability of the separation may be even further improved.

SUMMARY

A separation unit for separating a web material having a web width along preformed lines of weakness, the separation unit having a width direction and comprising at least a first shaft extending along a first longitudinal axis in the width direction and at least a second shaft extending along a second longitudinal axis in parallel with the first shaft, the second longitudinal axis being positioned at a distance from the first longitudinal axis in a direction perpendicular to the width direction at least one first protrusion element extending perpendicularly from the first shaft and arranged to be rotatable about the first longitudinal axis, and at least one second protrusion element extending perpendicularly from the second shaft and arranged to be rotatable about the second longitudinal axis, wherein, in a use position of said separation unit, the first and second protrusion elements are arranged in a staggered relationship such that the protrusion element of the first shaft is partially overlapping with the protrusion element of the second shaft with a radial overlap length in a direction perpendicular to the shafts, thus forming an undulating passage for the web material between the shafts with the web width extending in said width direction. At least one contact element is arranged in biased abutment against at least one of the first and second protrusion elements, in a direction perpendicular to the first or second longitudinal axis about which the at least one protrusion element is arranged.

That the at least one contact element is arranged in biased abutment against at least one of the first and second protrusion elements when the separation is in a use position means that, when the separation unit is in a position useful for separating web material, but no web material is present in the separation unit, the contact element will directly abut the at least one first or second protrusion element. When a web material is present in the separation unit, the web material may pass between the contact element and the protrusion element. When a weakening line reaches the contact element, the biasing pressure thereof will assist in rupturing the web material at the part of the weakening line adjacent the contact element. The complete separation of the web material along the full width of the weakening line is ascertained by the passing of the web material through the undulating passage.

The contact element may be designed so as to provide frictional contact towards the protrusion element, and hence to the web material which, in use, will be positioned in between the protrusion element and the contact element. An outer surface of the contact element may be adapted so as to provide sufficient friction. For example, the outer surface of the contact element may be smooth or textured. Also, the material of the contact element may be selected so as to provide the desired friction.

Optionally, the contact element is arranged so as to non-rotatable about the first and/or second longitudinal axis.

Optionally, the contact element is arranged in connection to the first or second longitudinal axis opposing the at least one protrusion element.

For example, the contact element may be connected to the first or second shaft. In another example, the contact element may be connected at or adjacent shaft fixation members for mounting the shafts in the separation unit.

Optionally, the contact element is arranged so as to be fixed in relation to the first longitudinal axis of the first shaft when arranged in biased abutment against a protrusion element of the second shaft.

Optionally, the contact element is arranged so as to be fixed in relation to the second longitudinal axis of the second shaft when arranged in biased abutment against a protrusion element of the first shaft.

Optionally, the contact element comprising an outer surface forming a pressure nip with the protrusion element. By "pressure nip" it is to be understood that a web material passing the pressure nip will be pressed between the contact element and the protrusion element. Hence, no cutting or piercing takes place. It will be understood that in such a pressure nip, the contact element may be fixed in relation to the longitudinal axis of the protrusion element, whereas the protrusion element may be rotatable.

Optionally, the at least one contact element is forming a concave outer surface towards the at least one protrusion element, as seen in a plane perpendicular to the width direction.

Optionally, the at least one contact element is forming a convex outer surface towards the at least one protrusion element, as seen in a plane perpendicular to the width direction.

Optionally, the at least one contact element is forming a straight outer surface towards the at least one protrusion element, as seen in a plane perpendicular to the width direction.

Optionally, the at least one contact element is arranged in biased abutment against at least two protrusion elements.

Optionally, the at least one first contact element is arranged in biased abutment against at least one protrusion element of the first shaft, and at least one second contact element is arranged in biased abutment against at least one protrusion element of the second shaft.

Optionally, the separation unit comprises a biasing means arranged to bias the contact element towards the protrusion element, preferably the biasing means comprises a spring.

Optionally, the first shaft is movably suspended, perpendicularly to the first longitudinal axis, and the biasing means is arranged to bias the first shaft towards the second shaft.

Optionally, the distance between the first and second longitudinal axes of the first and second shafts is 10 to 30 mm, preferably 15 to 25 mm.

Optionally, the distance between the longitudinal axis of the first and second shafts is adjustable. Preferably, the adjustment is enabled by the biasing means.

Optionally, the longitudinal axis of the second shaft is fixed.

Optionally, the separation unit comprises a first guiding part fixedly arranged in relation to the first longitudinal axis of the first shaft, and comprising a first guiding surface for the web material. Advantageously, the contact element is formed by at least a part of the first guiding surface.

Optionally, the separation unit comprises a second guiding part, fixedly arranged in relation to the second longitudinal axis of the second shaft, and comprising a second guiding surface for the web material. Advantageously, the contact element is formed by at least a part of the second guiding surface.

Optionally, the protrusion elements are disc elements.

Optionally, the protrusion elements are fixedly arranged with respect to the shaft, respectively.

Optionally, the protrusion elements are rotatably arranged with respect to the respective shaft.

Optionally, each one of the first and second shaft is provided with a plurality of protrusion elements being spaced along the longitudinal axes, preferably between two and eight protrusion elements, most preferred between four and six protrusion elements.

Optionally, each of the first and the second shaft has a central portion and peripheral portions in the width direction, and wherein the spacing between the protrusion elements is greater in the central portion than in the peripheral portions, on at least one of the first and second shafts, preferably both of the first and the second shaft. Optionally, at least one of the first and second shafts comprises at least a first, a second and a third protrusion element, wherein the spacing between the first and the second protrusion elements along the width direction of the shaft differs from the spacing between the second and the third protrusion elements along the width direction of the same shaft. Alternatively, at least one of the first and second shafts comprises a plurality of protrusion elements, the protrusion elements being arranged with the same mutual spacing along the shaft.

Optionally, each protrusion element has a maximum radial extension from the respective longitudinal axis, the maximum radial extension being between 5-50 mm, preferably 5-30 mm, more preferably 10-20 mm, or most preferably 12-18 mm.

Optionally, the maximum widths of the protrusion elements may be 4-20 mm, preferably 5-10 mm, most preferably 6-8 mm.

Optionally, the radial overlap length is 2-40 mm, preferably 2-20 mm, more preferably 3-12 mm, or most preferably 4-10 mm.

Optionally, the protrusion elements of the separation unit may all be of the same maximum radial extensions and the same maximum widths. In this case, the protrusion elements of the separation unit may all be uniform.

Optionally, at least two protrusion elements of the separation unit have different maximum radial extensions and/or different maximum widths.

Optionally, the axial spacing between each two protrusion elements on the same shaft is greater than the maximum width of each protrusion element.

There is also provided a dispenser for a web material comprising preformed lines of weakness, the dispenser comprising a housing defining a web material reservoir, and a dispensing opening, which dispenser comprises a separation unit as described in the above.

Optionally, the dispenser may comprise a guiding element determining a correct tension and path of the web material.

The dispenser may further comprise a web material contained inside the housing. The web material comprises preformed lines of weakness and may be Z-folded to form a stack, or be in the form of a roll.

A leading portion of the web material may be configured to be supported in a dispensing path from the reservoir to the dispensing opening. The leading portion may extend upwardly from the top of the stack of the web material, or from the peripheral or central part of the roll.

The preformed lines of weakness may be perforation lines formed by alternating bonds and slots and having the perforation strength between 20-80 N/m, preferably 30-45 N/m measured using SS-EN ISO 12625-4:2005. This perforation strength may for instance be achieved by using perforation lines wherein the total bond length/(the total bond length+total slot length) is between 4% and 10%. It is desired to form perforation lines which are strong enough to enable feeding of the web material, but which are also weak enough to enable separation of the sheets along the perforation lines using the separation unit of the present invention. In this context, it is known that also other parameters may influence the strength of the perforation line, such as the paper quality, and the size, shape and distribution of the slots and bonds. However, it is believed that the above-mentioned measure is useful for guiding the person skilled in the art when selecting suitable perforation lines.

The web material may be a two-layer structure, i.e. the web material may comprise at least a first web layer divided into sheet products defined between longitudinally separated preformed lines of weakness extending across the first layer; and at least a second web layer divided into sheet products defined between longitudinally separated lines of weakness extending across the second web layer. The web layers may be interfolded so that the lines of weakness of the first web layer are offset from the lines of weakness of the second web layer in a longitudinal direction.

Further, the dispenser may comprise a feeding mechanism, i.e. a motor to advance a web through the dispenser.

Further features of, and advantages with, the present invention will become apparent when studying the appended claims and the following detailed description. Those skilled in the art will realize that different features of the present invention may be combined to create embodiments other than those described in the following, without departing from the scope of the present invention, as defined by the appended claims.

BRIEF DESCRIPTION OF THE DRAWINGS

Embodiments of the invention will now be described by way of example with reference to the accompanying drawings, of which.

DETAILED DESCRIPTION

The present invention will now be described more fully with reference to the accompanying drawings, in which example embodiments are shown. However, this invention should not be construed as limited to the embodiments set forth herein. Disclosed features of example embodiments may be combined as readily understood by one of ordinary skill in the art to which this invention belongs. Like numbers refer to like elements throughout. For brevity and/or clarity, not all reference numbers are necessarily displayed in all drawings. Well-known functions or constructions will not necessarily be described in detail for brevity and/or clarity.

Figure 1A:
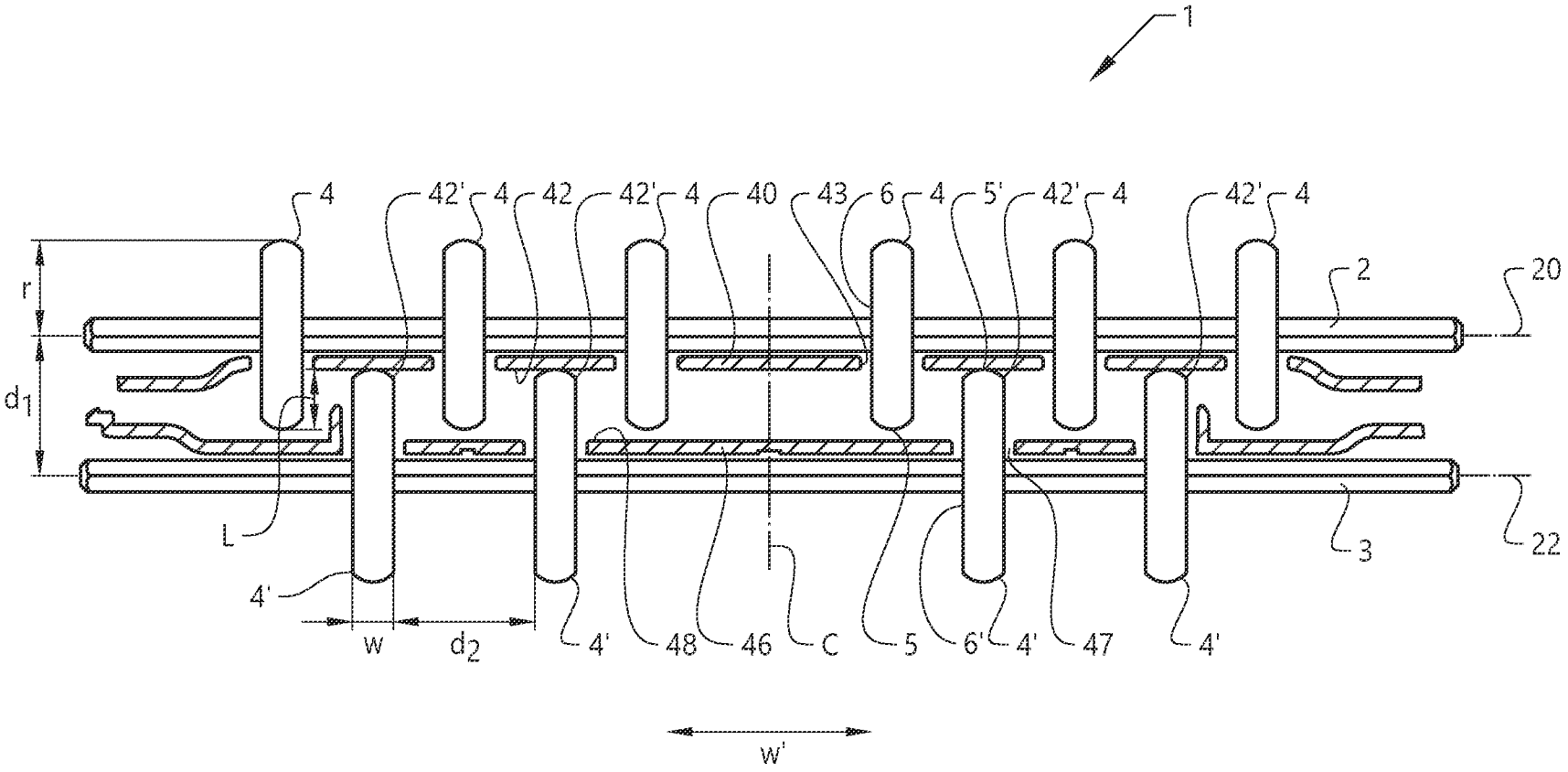
FIGS. 1*a*, 1*b* and 1*c* schematically show an example of an arrangement of the shafts, protrusion elements and guiding parts/contact element in an embodiment of a separation unit according to the present invention.
Figure 1B:
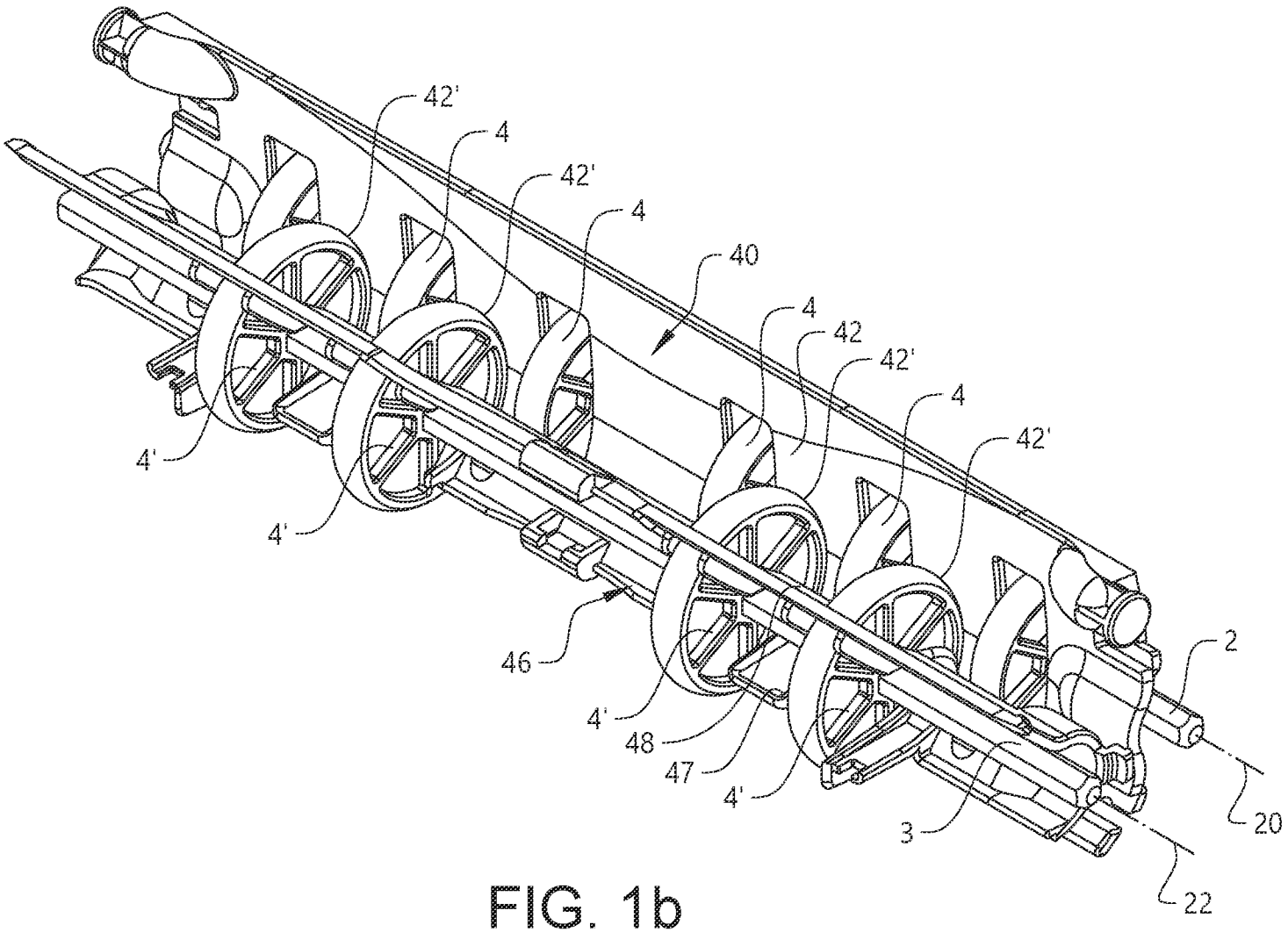
Figure 1C:
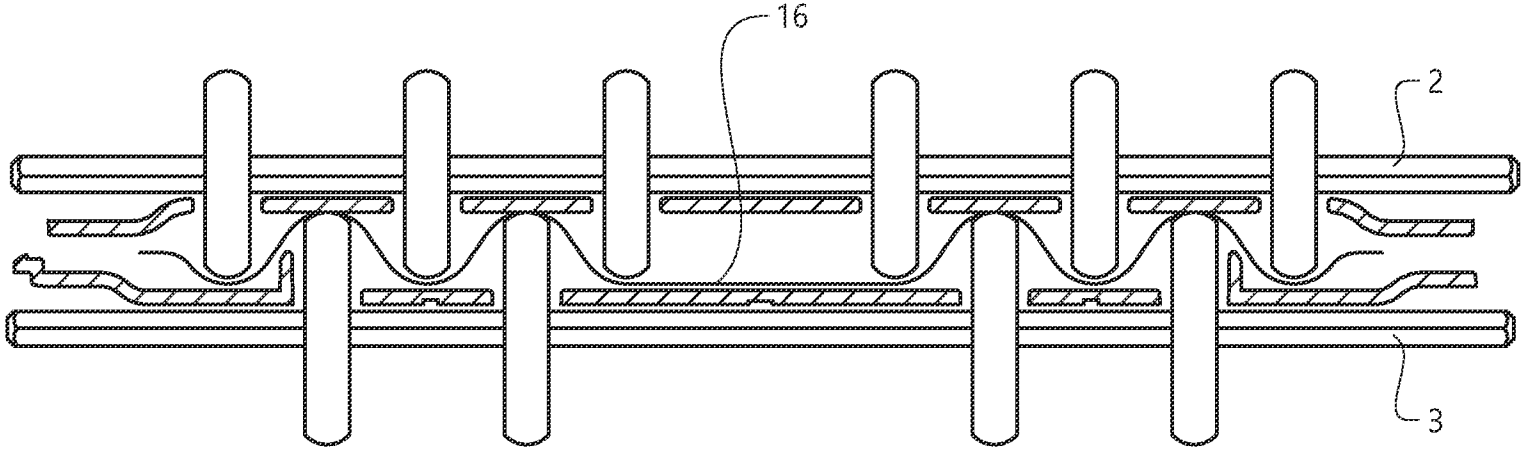

FIGS. 1*a*, 1*b*, and 1*c* schematically illustrate embodiments of a separation unit 1 for separating a web material 16 along preformed lines of weakness. The separation unit 1 has a width direction W' and comprises a first shaft 2 having a first longitudinal axis 20 extending in the width direction W', and at least a second shaft 3 having a second longitudinal axis 22 extending parallel with the first longitudinal axis 20 in the width direction W'. The second longitudinal axis 22 of the second shaft 3 is positioned at a distance d1 from the first longitudinal axis 20 of the first shaft 2, the distance d1 extending in a direction perpendicular to the width direction W'. Each of the first and the second shafts 2, 3 is provided with at least one protrusion element 4, 4' extending perpendicularly from the respective longitudinal axis 20, 22. Each of the protrusion elements 4, 4' has a maximum width w in the width direction W', a maximum radial extension r from each of the longitudinal axes 20, 22, an inner portion 6, 6' adjacent to the respective of each longitudinal axis 20, 22, and an outer portion 5, 5' remote from the respective of each longitudinal axis 20, 22. The protrusion elements 4 on the first shaft 2 are arranged in a staggered relationship with the protrusion elements 4' on the second shaft 3. The protrusion elements 4 on the first shaft 2 are partially overlapping with the protrusion elements 4' on the second shaft 3 with a radial overlap length L, thus forming an undulating passage for a web material 16 between the shafts 2, 3.

Figure 2:
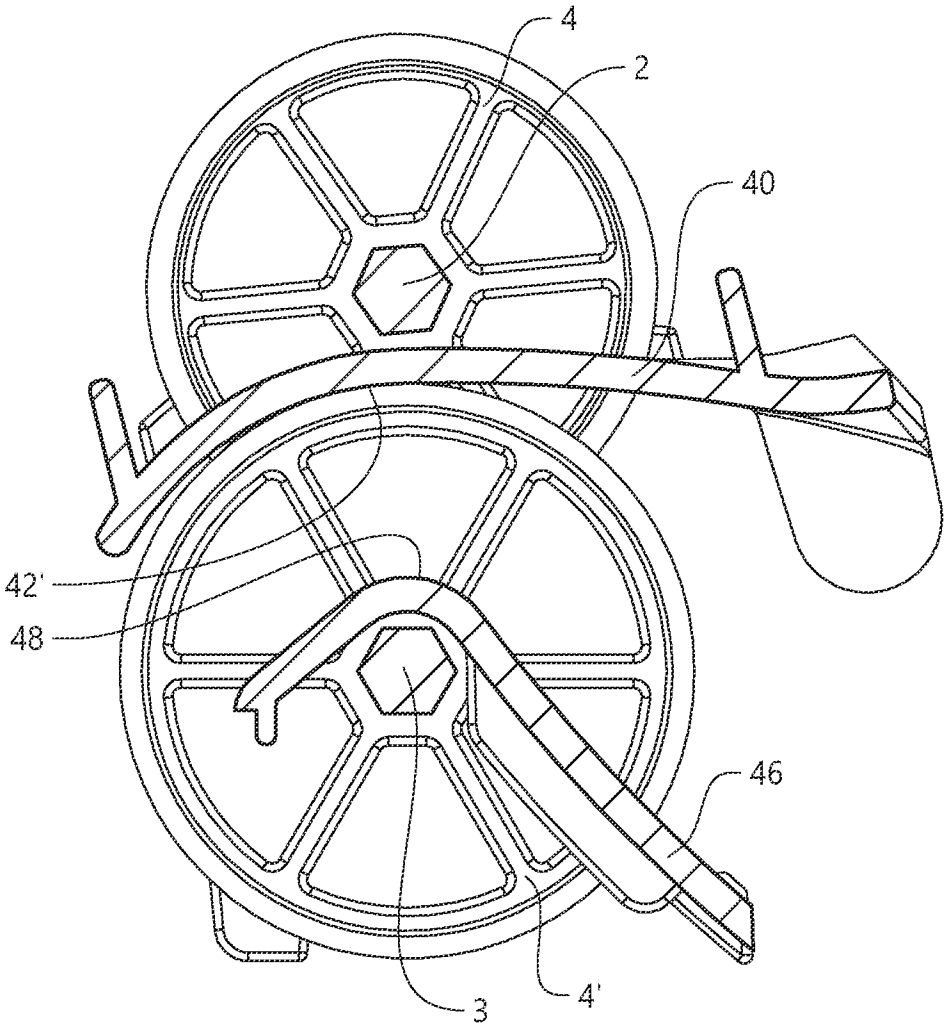
FIG. 2 illustrates schematically the arrangement according to FIGS. 1*a*-1*c* as seen in the width direction.

In FIG. 2, it may be more clearly seen how the protrusion elements 4 on the first shaft 2 overlap with the protrusion elements 4' on the second shaft 3 in a direction perpendicular to the width direction w'.

Due to the presence of the overlapping protrusion elements 4', 4 of the opposing first and second shafts 2, 3, an undulating passage is formed between the first and second shafts 2, 3, through which the web material 16 is arranged to pass, as seen in FIG. 1*c*. In use, the width direction of the web material 16 will extend along the width direction w' of the separation unit 1. When in the undulating passage, the web material will be subject to tension and/or stretching, causing a preformed line of weakness of the web material 16 to break. Thus, a sheet of web material may be separated from a leading portion of continuous web material.

It is to be noted that FIGS. 1*a*-1*c* all illustrate the separation unit 1 when in a use position. This is a position which the separation unit will assume when in use, as illustrated in FIG. 1*c*. In some embodiments, the separation unit 1 may be arranged so as to have other positions than the use position. For example, there may be a loading position wherein the distance d1 between the first shaft 2 and the second shaft 3 is increased so as to facilitate initial loading of a web material into the separation unit.

Also, in some embodiments, the distance d1 between the longitudinal axes 20, 22 of the first and the second shafts 2, 3 may be adjustable between different use positions. In this case, the radial overlap length L in the undulating passage may be variable between different use positions, which positions may hence be adapted for separating different web materials 16. With different web materials 16 is meant materials being different for example as to material content, strength, and/or weakening lines.

Mentioned purely as an example, the radial overlap length L between the outer portions 5 of the first and second protrusion elements 4, 4' may be adjustable between three fixed positions of the first shaft 2, may be approx. 6 mm, approx. 7 mm, and approx. 8 mm, respectively. Generally, a greater radial overlap length L will result in a greater pull force being required for pulling a web material 16 from the separation unit 1.

Also, in some embodiments, the first and/or second shaft 2, 3 may be biasedly suspended when in the use position, so as to enable the distance d1 to be temporarily increased so as to allow passage of a portion of the web material 16 displaying a thickness deviating from the nominal thickness of the web material 16. This arrangement is particularly advantageous when the web material comprises individual web lengths being interconnected so as to form a continuous web material. For example, this may be the result when a web material is provided in individual folded stacks, and a number of stacks are interconnected so as to form a continuous web material. The interconnections may be formed e.g. by glue attachment, hook-and-loop attachment or tape attachment. At such interconnections, the web thickness may deviate from a nominal web thickness due to the space required for the attachment. A biased arrangement of the shafts 2, 3 as described in the above, may provide the advantage of enabling passage of such interconnections through the separation unit without hindering the function thereof.

The maximum widths w and maximum radial extensions r of the protrusion elements may be varied so as to enable reliable separation of a desired web material. Also, the shape of the outer portions 5, 5' of the protrusion elements 4, 4' may vary. In the illustrated embodiment, the outer portions 5, 5' of the protrusion elements 4, 4' display a curved shape towards the web material.

Also, the surface towards the web material 16 of the outer portions 5, 5' of the protrusion elements 4, 4' may be varied. In the illustrated embodiment, the surface is generally smooth. Alternatively, the surface may be textured, for example ribbed. The first and second protrusion elements 4, 4' of the separation unit may all be uniform. Alternatively, two or more different protrusion elements 4, 4' may be used in one separation unit 1. Protrusion elements may vary as to size, shape, surface structure etc. In one embodiment, the first protrusion elements 4 may all be uniform, and the second protrusion elements 4' may all be uniform, but different from the first protrusion elements.

In the schematic FIGS. 1*a* and 1*c*, the first protrusion elements 4 of the first shaft 2 are illustrated with a radius r being slightly less than the radius r of the second protrusion elements 4' of the second shaft 3. However, it will be understood that the description of the illustrated embodiment applies equally for example to an embodiment where the first and second protrusion elements 4, 4' have the same diameter. In this case, the desired contact elements to be in biased abutment with selected first or second protrusion elements 4, 4' may be formed by designing the shape of the first guide part 40 or the second guide part 46 accordingly. To this end, the shape of the outer surface 42, 48 of the first and/or second guide part 40, 46 may be varied, and/or the distance between a guide part 40, 46 and the adjacent shaft 2, 3.

In an example embodiment, the protrusion elements 4, 4' are all uniform, disc shaped elements. In such an embodiment, the radius r of the protrusion elements 4, 4' may be about 17 mm and the width w about 6 mm. Also, in the example embodiment, the radial overlap length L may be about 10 mm.

In the illustrated embodiment, the first shaft 2 carries six first protrusion elements 4, and the second shaft 3 carries four second protrusion elements 4'.

In the illustrated embodiment, the first and second protrusion elements 4, 4' are divided into two groups being symmetrically arranged on each side of a central axis c, perpendicular to the width direction w'. In each group, the first protrusion element 4 of the first shaft 2 and the second protrusion elements 4' of the second shaft 3 are arranged with equal spacing d2. The smallest spacing between two protrusion elements 4 of the two different groups is larger than the said spacing d2 between elements 4, 4' inside each group.

In the illustrated embodiment, the first and second protrusion elements 4, 4' are fixedly arranged on the first and second shaft 2, 3, respectively. To this end, the shafts 2, 3, have a hexagonal cross-section (as seen in FIG. 2), and the inner portions 6, 6' of the first and second protrusion elements 4, 4' are provided with corresponding hexagonal holes. Accordingly, the required rotation of the first and second protrusion elements 4, 4' about the respective longitudinal axis 20, 22 is performed by allowing for rotation of the first and second shafts 2, 3, about the respective longitudinal axis 20, 22.

As explained in the above, the separation unit 1 may further comprise a contact element, being arranged in biased abutment against at least one of the first and second protrusion elements 4, 4', when the separation unit 1 is in a use position. The term "abutment" implies that the contact element shall be in contact with a protrusion element 4, 4' when the separation unit 1 is in a use position and when no web material is present in the separation unit 1.

In the embodiment of FIGS. 1*a*-1*c*, the contact element 42' is formed by a first guiding surface 42 of a first guiding part 40.

The first guiding part 40 is arranged so as to assist in guiding the web material 16 in the undulating passage. The first guiding part 40 may extend upstream and/or downstream the undulating passage. The first guiding part 40 will be positioned between the web material 16 in the undulating passage and the rotating second shaft 3, so as to hinder contact between the web material 16 and the shaft 3. Hence, the first guiding part 40 serves the purpose of guiding and protecting the web material 16.

To this end, the first guiding part 40 is arranged so as to extend along the width direction w' of the first shaft 2, at least between two of the first protrusion elements 4. In the illustrated embodiment, the first guiding part 40 extends along the majority, even essentially the full length of the first shaft 2 in the width direction w'. The first guiding part 40 extends between all of the first protrusion elements 4.

Moreover, the first guiding part 40 is provided with openings 43, through which the first protrusion elements 4 may protrude. The openings 43 are designed so as not to hinder the rotation of the protrusion elements 4.

The first guiding part 40 is arranged so as to be in a fixed position in relation to the first longitudinal axis 20 of the first shaft 2. Hence, the first guiding part 40 is not intended to rotate with the rotation of the first or second protrusion elements 4, 4'. To this end, in the illustrated embodiment where the first shaft 2 is rotatable, the first guiding part 40 may for example be fixedly suspended at its longitudinal ends, adjacent a suspension of the first shaft 2.

The first guiding part 40 comprises a first guiding surface 42 for the web material 16. The first guiding surface 42 may in accordance with the above extend between at least some of the protrusion elements 4 of the first shaft 2. Hence, at least a part of the first guiding surface 42 will oppose the second protrusion elements 4' of the second shaft 3.

As seen in FIG. 2, in the illustrated embodiment the outer surface 42 of the first guiding part 40 forms a curved shape opposing the second protrusion elements 4' of the second shaft 3. In the illustrated embodiment, the first guiding part 40 forms a concave shape towards the second protrusion elements 4', so as to correspond to at least a portion of the circular outer surface of the outer portion 5' of the second protrusion element 4'.

In accordance with what is proposed herein, the first guiding part 40 is moreover arranged in biased abutment with at least one of said protrusion elements 4' of the second shaft 3. Hence, when no web material is present in the separation unit, and the separation unit 1 is in a use position, as illustrated in FIG. 1*a*, the first guiding surface 42 will be biased to abut at least one of the protrusion elements 4' of the second shaft.

In FIG. 1*a*, in the first guiding surface 42 is arranged in contact with all of the protrusion elements 4' of the second shaft 3. This is to illustrate the first guiding surface 42 being in biased abutment with all of the protrusion elements 4' of the second shaft. However, other options are possible. For example the first guiding surface 42 could be arranged so as to be in biased abutment against only one or some of the protrusion elements 4' of the second shaft 3.

Hence, the first guiding part 40 forms not only a guiding means for the web material, but also a contact element 42' as described herein.

When the separation unit 1 is in use (FIG. 1*c*), the web material 16 will be subject to some pressure from the contact element 42', i.e. from the first guiding part 40 being biased towards the web material 16 where supported by a second protrusion element 4'. Without being bound by theory, it is believed that the increased friction resulting over the portion of a weakening line in the web material 16 which is in contact with the contact element 42' will assist in creating a first rupture of the weakening line. The remainder of the separation of the web material 16 along a weakening line is believed to be performed by the undulating passage of the separation unit, as described in the above.

By forming the contact element 42' using a first guiding part 40, an increased reliability of the separation unit may be accomplished without adding additional parts. However, it will be understood that numerous alternative embodiments are possible. In particular, it is not necessary to utilise a guiding part 40 to form the contact element.

Optionally, and as in the described embodiment, the contact element may have an outer surface 42 forming a pressure nip with the protrusion element 4'. As described in relation to FIG. 2, the first guiding surface 42 is formed so as to at least partly correspond to the outer shape of the outer portions 5' of the protrusion element 4'. Accordingly, the first guiding surface 42 and the protrusion element 4' will meet over contact surfaces having an extension so as to form a pressure nip, which may be non-destructive to the web material passing by the pressure nip. This is in contrast to e.g. cutters or the like which may cut e.g. a perforation open, but which will also be destructive and risk damaging the web material 16 between the weakening lines.

In the embodiment of FIGS. 1*a* to 1*c*, there is further a second guiding part 46 fixedly arranged in relation to the second longitudinal axis 22. The second guiding part 46 is arranged in connection with the second shaft 3 and comprises a second guiding surface 48 for the web material. The second guiding surface 48 extends between at least some of the second protrusion elements 4' of the second shaft 3. The second guiding surface 48 extends upstream and downstream of the protrusion elements 4' of the second shaft 3.

However, in the illustrated embodiment, the second guiding surface 48 is not arranged to be in biased abutment with at least one of the protrusion elements 4 of the first shaft 2, when in a use position as illustrated in FIGS. 1*a*-1*c*. Still, one may easily imagine an alternative embodiment, wherein also the second guiding surface 48 is arranged such that at least a part of it forms a contact element being arranged in biased abutment against at least one protrusion element 4 of the first shaft 2.

The second guiding part 46 displays several similarities with the first guiding part 40. For example, the second guiding part 46 is provided with openings 47 through which the second protrusion elements 4' of the second shaft 3 may protrude. The second guiding part 46 forms a convex outer surface 48 towards the first protrusion elements 4, as may be understood from FIG. 2. However, such a convex outer surface 48 is another option for forming a contact element in biased abutment with the first protrusion elements 4 of the first shaft 2. Such a convex outer surface may form a pressure nip with the circular outer portion 5 of the first protrusion element 4.

In particular, there is proposed an embodiment being similar in structure to what is described in FIGS. 1*a* to 1*c*, and 2, but wherein the first guiding part forms a contact element being in biased abutment with the second and the fifth of the first contact elements of the first shaft only, as counted from the left in FIG. 1*b*, and where the second guiding part forms a contact element being in biased abutment with the second and the third of the second contact elements of the second shaft only.

Generally, when the first and second protrusion elements 4, 4' are divided into two groups on each side of a central axis c, as described in the above, it may be desired to provide each group with at least one contact element being arranged in biased abutment with at least one protrusion element 4, 4' in said group.

Also, when the first and second protrusion elements 4, 4' are divided into two symmetrical groups on each side of a central axis c, it may be desired to provide each group with at least one contact element being arranged in biased abutment with at least one protrusion element 4, 4', where said protrusion element is other than outermost arranged, as seen in the width direction w', in said group.

In view of the above, it will be understood that the biasing of the first guiding part 40 (or second guiding part 46 in other embodiments) so as to ensure the contact element being in biased abutment with at least one protrusion element 4, 4' may be performed in different manners. For example, the first guiding part 40 may be provided with a separate biasing element, e.g. a spring, for example arranged in connection with the suspension of the longitudinal ends of the first guiding part 40 in a separation unit 1.

An embodiment of the biasing will now be described with reference to FIGS. 3 and 4. In the illustrated embodiment, the suspension of the longitudinal ends of the first and second shafts 2, 3, and the first and second guiding parts 40, 46 is divided into groups.

The second shaft 3 and the second guiding part 46 are both arranged in fixed side portion A. The second shaft 3 is rotatably arranged to a fixed side portion A of the separation unit 1. Also, in this embodiment, a feeding wheel 50 is connected to the second shaft 3 so as to enable manual rotation of the second shaft 3. The second guiding part 46 is fixedly arranged to the fixed side portion A of the separation unit A.

The first shaft 2 and the first guiding part 40 are both arranged in a pivotable side portion B, which is pivotable in relation to the fixed side portion A of the separation unit. The first shaft 2 is hence rotably arranged, and the first guiding part 40 is fixedly arranged to the pivotable side portion B.

Figure 3:
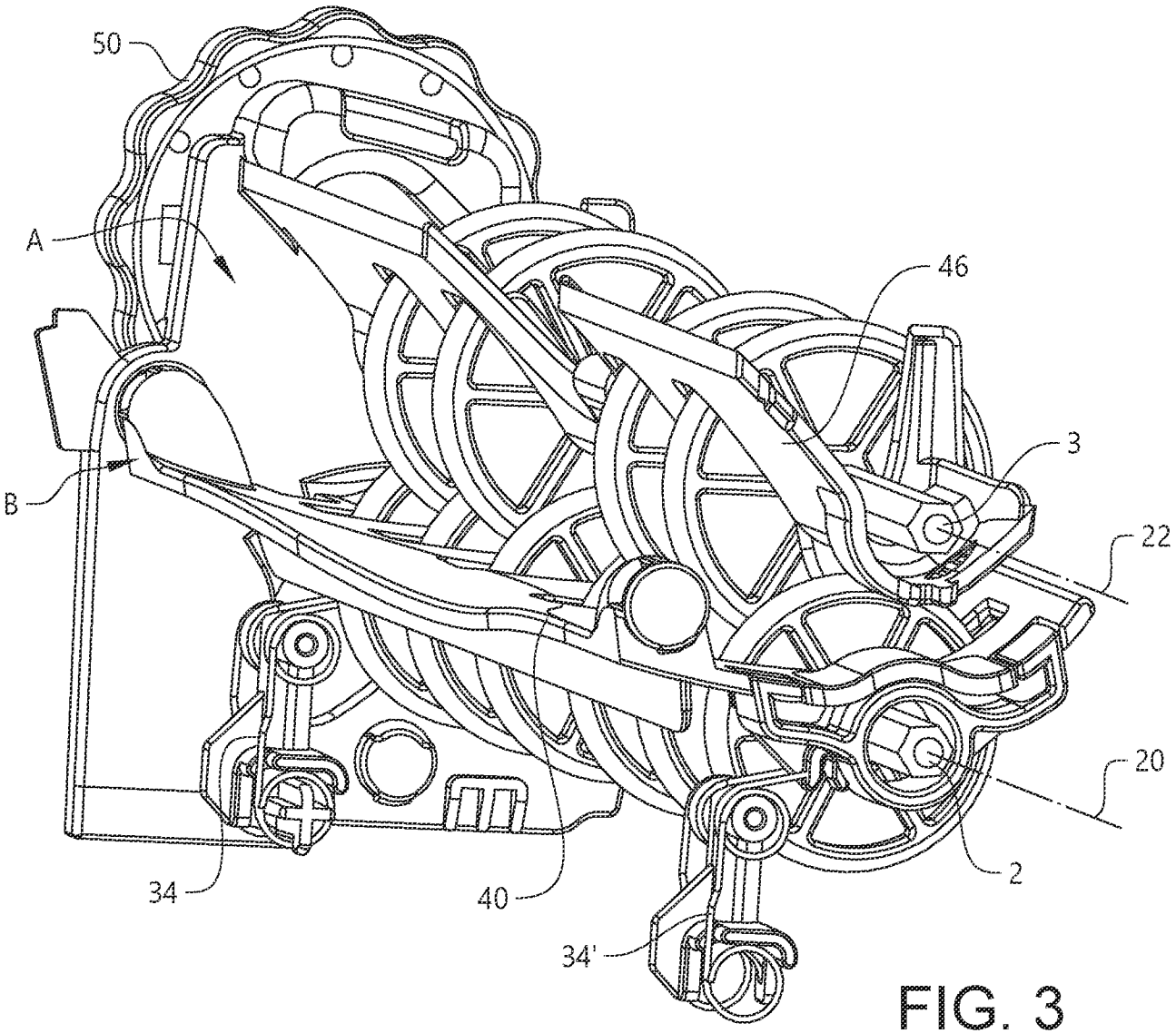
FIG. 3 illustrates a part of an embodiment of a separation unit showing the suspension of an arrangement of FIGS. 1*a*-1*c;*
Figure 4:
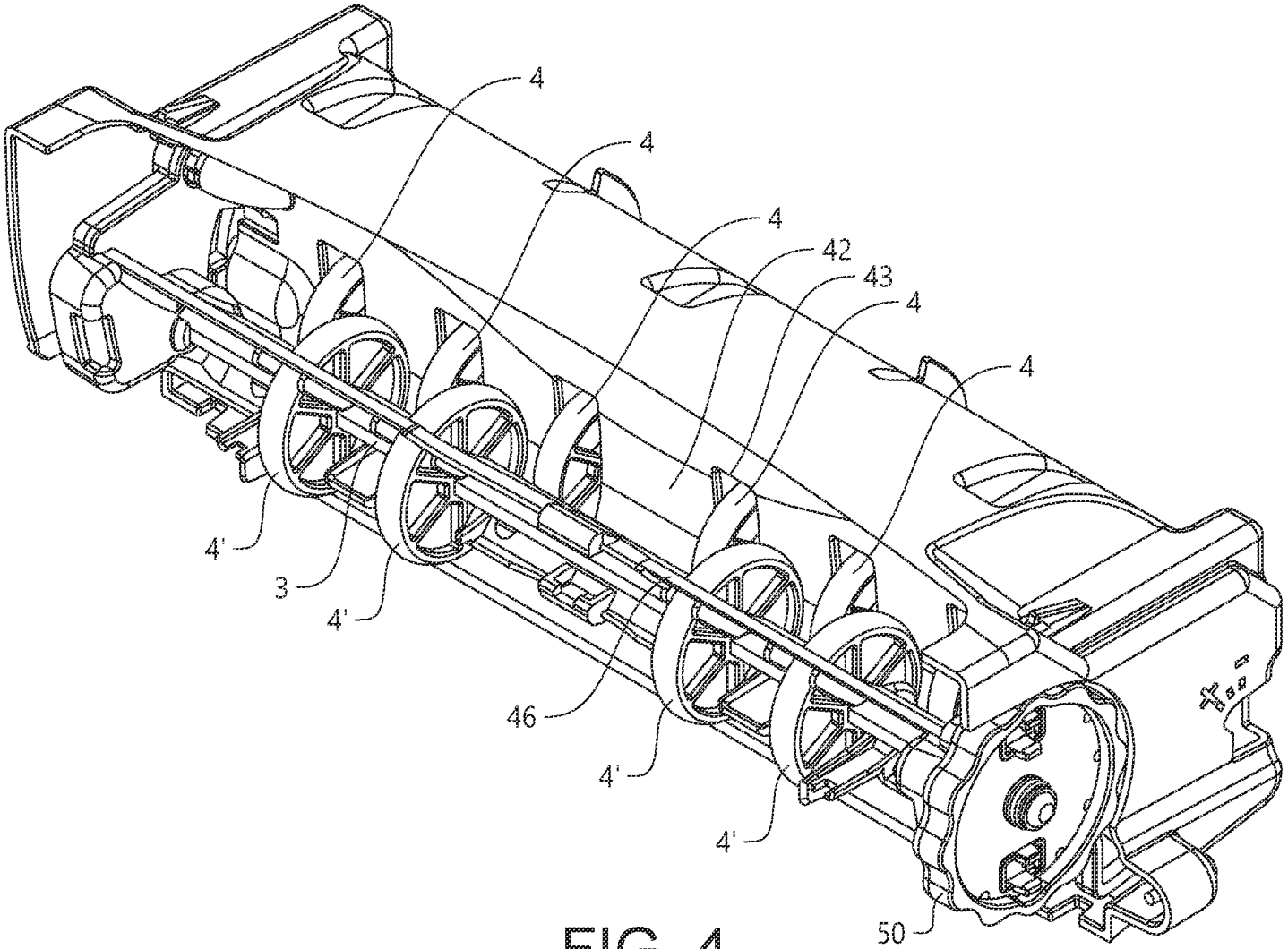
FIG. 4 illustrates the embodiment of FIG. 3 of the separation unit in a perspective view.

As seen in FIG. 3, the pivotable side portion B carrying the first shaft 2 and the first guiding part 40 is biased towards the fixed side portion A by means of biasing elements 34, 34' comprising two spring elements. Hence, in a use position, the biasing elements 34, 34' will bias the pivotable side portion B towards the fixed side portion A. Accordingly, the biasing elements 34, 34' will bias the first shaft 2 and the first guiding part 40 towards the second shaft 3 and the second guiding part 46.

In this embodiment, the biasing will hence be effective both to provide for resilience of the separation unit to intermittent variations in the thickness of the web material, such as when interconnections between web material pass the separation unit, and to provide for the contact element (first guiding part 40) being biased towards the second protrusion elements 4' of the second shaft 3 in a direction perpendicular to the width of the separation unit 1. Accordingly, the separation unit 1 may be simply made using a reduced number of parts.

Moreover, the side portion B being pivotably arranged in relation to the fixed side portion A enables embodiments where the side portion B may be pivoted away from the side portion A, to form e.g. a threading position of the dispenser.

Advantageously, the rotation of the first and the second shafts 2, 3 may be driven by a cog wheel arrangement, preferably ensuring synchronised rotation of the first and second shafts 2, 3.

Figure 5:
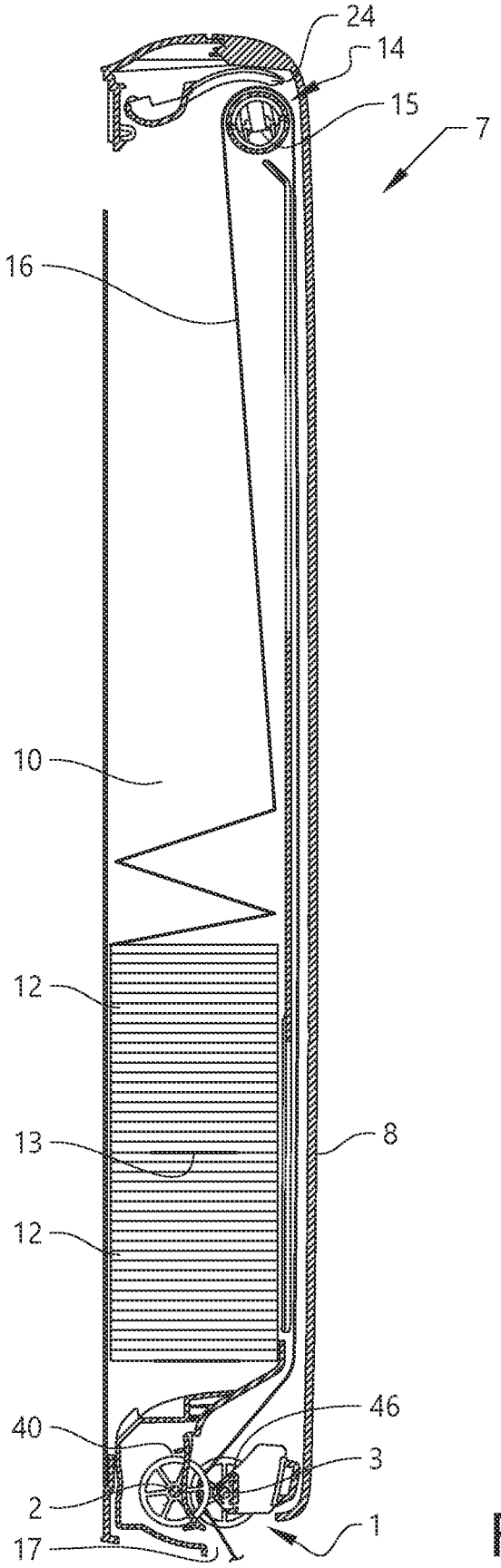
FIG. 5 schematically illustrates a dispenser comprising a separation unit.

FIG. 5 schematically shows a dispenser 7 with a separation unit 1. The dispenser 7 has an outer front wall 8, two outer side walls and a housing 10. The housing 10 is intended for holding a storage of web material 16 in the form of a pile or stack of a continuous length of accordion-like folded web of towels of tissue paper or nonwoven, comprising bundles 12 of a continuous length of accordion-like folded web of towels of tissue paper or nonwoven. Thus, the housing 10 defines a web material reservoir. The bundles 12 comprise connecting means 13 between the bundles 12. The dispenser 7 comprises a guiding element 14 in the form of a curved plate 24 which extends over a segment of a web-supporting element 15. The at least one web 16 is arranged to be fed through the guiding element 14 when the dispenser 7 is in use, and at least one part of the guiding element 14 is arranged to bear against the web 16. The guiding element 14 thereby holds the at least one web 16 in place on the web-supporting element 15 so that it does not move backwards or sidewards during the use of the dispenser, or in case of web-breakage.

The unit subsequent to the guiding element 14 is the separation unit 1 described above. The separation unit 1 acts on the web material 16, and allows the web material 16 to be separated at the weakening lines thereof. The separation unit 1 depicted in FIG. 5 is configured such that both of the shafts 2, 3 are positioned inside the housing 10. It is also conceivable that one of the longitudinal axes is 20, 22 located in the outer front wall 8, such that when the outer front wall 8 is opened, the separation unit 1 is opened.

The dispenser 7 illustrated in FIG. 5 comprises a stack of interfolded webs 16, whereby the dispenser 7 is configured so that the stack of interfolded webs in the housing 10 has to be lifted to position a new bundle 12 of web material in the housing 10 underneath the stack to refill the dispenser 7. Bundles 12 of interfolded webs in the dispenser 7 may be interconnected via connecting means 13, such as adhesive, adhesive tape or mechanical fasteners, such as hook and loop fasteners, at the bottom and/or top of each of the refill stacks. The web 16 is arranged to be fed upwards within the housing 10, around the web-supporting element 15 located at the top of the dispenser 7 and downwards towards the separation unit 1 and the dispensing opening 17.

The dispenser 7 may be mounted on any suitable object, for example a wall, in any suitable manner. Optional dispenser variants may be free-standing units. Furthermore, a dispenser housing 10 of a dispenser according to the present invention need not necessarily contain an entire web 16 that is to be dispensed by the dispenser 7. At least one web 16 may for example be stored outside the housing 10 and merely be fed through the housing 10 when the dispenser 7 is in use.

Although the present invention has been described with reference to various embodiments, those skilled in the art will recognise that changes may be made without departing from the scope of the invention. It is intended that the detailed description be regarded as illustrative and that the appended claims including all the equivalents are intended to define the scope of the invention.

Example embodiments described above may be combined as understood by a person skilled in the art. Although the invention has been described with reference to example embodiments, many different alterations, modifications and the like will become apparent for those skilled in the art. For instance, the second shaft 3 may be biased towards the first shaft 2, instead of the first shaft 2 being biased towards the second shaft 3, or in addition to the first shaft 2 being biased towards the second shaft 3. The first and/or the second shafts 2, 3 may comprise separate shaft portions aligning along the respective first and second longitudinal axes 20, 22. Numerous options for forming contact elements are conceivable.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A separation unit for separating a web material having a web width along preformed lines of weakness, the separation unit having a width direction and comprising:

at least a first shaft extending along a first longitudinal axis in the width direction;

at least a second shaft extending along a second longitudinal axis in parallel with the first shaft, the second longitudinal axis being positioned at a distance from the first longitudinal axis in a direction perpendicular to the width direction;

at least one first protrusion element extending perpendicularly from the first shaft and being arranged to be rotatable about the first longitudinal axis; and at least one second protrusion element extending perpendicularly from the second shaft and being arranged to be rotatable about the second longitudinal axis, wherein, in a use position of the separation unit, the first and second protrusion elements are arranged in a staggered relationship such that the protrusion element of the first shaft is partially overlapping with the protrusion element of the second shaft with a radial overlap length in a direction perpendicular to the shafts, thus forming an undulating passage for the web material between the shafts with the web width extending in the width direction, wherein the separation unit also comprises at least one contact element that is arranged in biased abutment against at least one of the first and second protrusion elements in a direction perpendicular to the first or second longitudinal axis about which the at least one of the first and second protrusion elements is rotatably arranged, the at least one contact element being positionable between the web material and at least one of the first shaft and the second shaft and including one or more openings through which at least one of the first protrusion elements and the second protrusion elements extend.

2. The separation unit of claim 1, wherein the at least one contact element is arranged so as to be non-rotatable about the first and/or the second longitudinal axis.

3. The separation unit of claim 1, wherein the at least one contact element is arranged in connection to the first or second longitudinal axis opposing the at least one protrusion element.

4. The separation unit of claim 1, wherein the at least one contact element is arranged so as to have a fixed position in relation to the first longitudinal axis of the first shaft when arranged in biased abutment against a protrusion element of the second shaft.

5. The separation unit of claim 1, wherein the at least one contact element is arranged so as to have a fixed position in relation to the second longitudinal axis of the second shaft when arranged in biased abutment against a protrusion element of the first shaft.

6. The separation unit of claim 1, the at least one contact element comprising an outer surface forming a pressure nip with the at least one protrusion element.

7. The separation unit of claim 1, wherein the at least one contact element is forming a concave outer surface towards the at least one protrusion element, as seen in a plane perpendicular to the width direction.

8. The separation unit of claim 1, wherein the at least one contact element is forming a convex outer surface towards the at least one protrusion element, as seen in a plane perpendicular to the width direction.

9. The separation unit of claim 1, wherein the at least one contact element is forming a straight outer surface towards the at least one protrusion element, as seen in a plane perpendicular to the width direction.

10. The separation unit of claim 1, wherein the at least one contact element is arranged in biased abutment against at least two protrusion elements, or wherein at least one first contact element is arranged in biased abutment against the at least one protrusion element of the first shaft, and at least one second contact element is arranged in biased abutment against the at least one protrusion element of the second shaft.

11. The separation unit of claim 1, further comprising a biasing element arranged to bias the at least one contact element towards the at least one protrusion element, wherein the biasing element comprises a spring, wherein the first shaft is movably suspended, perpendicularly to the first longitudinal axis, and wherein the biasing element is arranged to bias the first shaft towards the second shaft, and wherein the second longitudinal axis of the second shaft is fixed.

12. The separation unit of claim 1, further comprising a first guiding part fixedly arranged in relation to the first longitudinal axis of the first shaft, and comprising a first guiding surface for the web material, wherein the at least one contact element is formed by at least a part of the first guiding surface.

13. The separation unit of claim 12, further comprising a second guiding part, fixedly arranged in relation to the second longitudinal axis of the second shaft, and comprising a second guiding surface for the web material, wherein the at least one contact element is formed by at least a part of the second guiding surface.

14. The separation unit of claim 1, wherein the at least one protrusion elements are disc elements.

15. The separation unit of claim 1, wherein the at least one protrusion elements are fixedly arranged with respect to the shaft, respectively.

16. The separation unit of claim 1, wherein the at least one protrusion elements are rotatably arranged with respect to the shaft.

17. The separation unit of claim 1, wherein each of the first and second shafts is provided with a plurality of protrusion elements being spaced along the first and second longitudinal axes, the plurality of protrusion elements including between two and eight protrusion elements, wherein each of the first and the second shafts has a central portion and peripheral portions in the width direction, and wherein a spacing between the protrusion elements is greater in the central portion than in the peripheral portions, on at least one of the first and second shafts, preferably both of the first and the second shafts.

18. The separation unit of claim 1, wherein each protrusion element has a maximum radial extension from the respective longitudinal axis, the maximum radial extension being between 5 mm and 50 mm, wherein maximum widths of the at least one protrusion elements are between 4 mm and 20 mm, and wherein the radial overlap length is 2 mm to 40 mm.

19. The separation unit of claim 1, wherein the contact element is arranged at at least one of the first shaft and the second shaft.

20. The separation unit of claim 1, wherein the biased abutment of the at least one contact element against at least one of the first and second protrusion elements is operable to tear the web material at a perforation line.

21. A dispenser for a web material comprising preformed lines of weakness, the dispenser comprising:

a housing defining a web material reservoir, a dispensing opening, and a separation unit having a width direction and comprising:

at least a first shaft extending along a first longitudinal axis in the width direction;

at least a second shaft extending along a second longitudinal axis in parallel with the first shaft, the second longitudinal axis being positioned at a distance from the first longitudinal axis in a direction perpendicular to the width direction;

at least one first protrusion element extending perpendicularly from the first shaft and being arranged to be rotatable about the first longitudinal axis; and at least one second protrusion element extending perpendicularly from the second shaft and being arranged to be rotatable about the second longitudinal axis, wherein, in a use position of the separation unit, the first and second protrusion elements are arranged in a staggered relationship such that the protrusion element of the first shaft is partially overlapping with the protrusion element of the second shaft with a radial overlap length in a direction perpendicular to the shafts, thus forming an undulating passage for the web material between the shafts with the web width extending in the width direction, wherein the separation unit also comprises at least one contact element that is arranged in biased abutment against at least one of the first and second protrusion elements in a direction perpendicular to the first or second longitudinal axis about which the at least one of the first and second protrusion elements is rotatably arranged, the at least one contact element being positionable between the web material and at least one of the first shaft and the second shaft and including one or more openings through which at least one of the first protrusion elements and the second protrusion elements extend.

22. The dispenser of claim 21, further comprising a guiding element determining a correct tension and path of the web material.

* * * * *